United States Patent [19]

Dery

[11] 4,065,848

[45] Jan. 3, 1978

[54] METHOD OF APPLYING AND REPAIRING REAR WINDOW DEFROSTER

[76] Inventor: Normand Dery, 25, Grande Fourche Nord, Sherbrooke, Quebec, Canada

[21] Appl. No.: 668,743

[22] Filed: Mar. 19, 1976

[30] Foreign Application Priority Data

Mar. 15, 1976 Canada ..... 247966

[51] Int. Cl.[2] ..... H05B 3/34

[52] U.S. Cl. ..... 29/611; 29/401 F; 219/203

[58] Field of Search ..... 29/611, 620, 621, 401 R, 29/401 E, 401 F; 338/308, 314, 30 G, 210, 212; 219/203, 522, 547, 543, 549, 526, 542; 156/94, 71

[56] References Cited

U.S. PATENT DOCUMENTS

| | | | |
|---|---|---|---|
| 3,590,371 | 6/1971 | Shaw, Jr. | 219/203 UX |
| 3,700,496 | 10/1972 | Plumat | 338/308 X |
| 3,705,047 | 12/1972 | Marriott | 29/611 X |
| 3,736,404 | 5/1973 | Eisler | 338/212 X |
| 3,757,087 | 9/1973 | Bernard | 219/203 X |
| 3,792,232 | 2/1974 | Zarenko | 219/203 X |
| 3,848,111 | 11/1974 | Brouneus | 338/308 X |

*Primary Examiner*—Victor A. DiPalma
*Attorney, Agent, or Firm*—Raymond Trudeau

[57] ABSTRACT

A defroster and a method for the installation of a defroster of the resistive type specifically designed to be installed on the rear window of a completely assembled motor vehicle, comprising heating conductors in the form of thin pre-glued strips of solid copper or copper alloy applied to the inside surface of the rear window in a first direction with two spaced apart connecting conductors in the traverse direction; apparatus designed for applying the various parallel heating conductors to the inside surface of the window; and a method for repairing pre-existing rear window defrosters comprising cleaning the area of the defect, applying a sufficient length of pre-glued solid copper or copper alloy overlapping the defective heating conductor securing the new strip in place and making electrical connections between the overlapping ends and the underlying heating conductor.

13 Claims, 13 Drawing Figures

METHOD OF APPLYING AND REPAIRING REAR WINDOW DEFROSTER

This invention relates to rear window defrosters of the resistive conductor type which are installed on the inside surface of a motor vehicle's rear window for increasing the temperature of the rear window in order to clear same of fog or frost. This invention is more particularly concerned with the installation of resistive type defrosters in motor vehicles which are already assembled with the rear window in place, and to the repairing of resistive rear window defrosters.

Resistive rear window defrosters have become quite popular in motor vehicles used in colder climates and fall into two distinct classes namely the factory installed version on the first hand and systems which are sold in kit form to be installed on the rear window inside a car which is already completely assembled, on the other. The factory installed models in general provide adequate defrosting, are practically invisible and will last for many years but they present two main limitations, firstly they must be installed on the glass panel before the panel is mounted to a car and consequently if a vehicle is sold without such a defroster, it can only be installed by changing the entire rear window which is an expensive and time consuming operation. This may also result in an improper installation of the new glass panel with consequential leaks. The other disadvantage is that the very fine lines of resistive material tend to be quite fragile and can be relatively easily damaged such as when cleaning the window with an abrasive substance or when some sharp object is unintentionally allowed to move against the inside surface of the window.

The other variety of rear window defrosters comprises different designs. One such defroster kit is of the transfer type wherein a very thin foil of conductive material is transferred from a clear transparent support that eventually will be removed leaving only a pattern of relatively wide silver looking bands on the inside surface of the window, and some attachment to make the connection to the motor vehicle's electrical system. A second type consists of a pattern of resistive lines mounted to a thin sheet of clear plastic which is intended to remain secured to the rear window. In both cases the resulting resistive defroster looks like an "added on" item whose dimensions do not conform in any way to the shape and size of the rear window and the overall appearance leaves much to be desired. Furthermore the system which requires the transfer of heating elements from a supporting backing to the inside surface of the window normally results in an extremely fragile defroster whose individual heating lines will very easily be broken or interrupted resulting in an unsatisfactory defrosting of the rear window.

Examples of such prior factory installed or after market resistive defrosters will be found in the following three United States patents; U.S. Pat. No. 3,700,496 to Plumat relating to a factory installed rear window defroster using the seizure method, U.S. Pat. No. 3,736,404 for an invention of Paul Eisler and U.S. Pat. No. 3,757,087 for an invention of Dominic Paul Edmund Bernard, the last two patents being concerned with after market rear window defrosters of the resistive type.

This invention aims at providing a rear window defroster of the resistive type and a method for the installation of such a defroster in a motor vehicle which is already assembled and which installation does not at all necessitate the removal of the rear window. A further aim of the invention is to provide a method for repairing resistive defrosters of which one or more heating lines are interrupted. It is also an object of this invention to provide a method for completely replacing a damaged factory installed resistive defroster by one which will exactly fit over the original heating lines.

The invention further aims at providing such a defroster as defined above whose pattern of heating conductors will be defined for each individual size and type of rear window so that its height and width will conform to the dimensions of the rear window. Another aim of the invention is to provide a resistive defroster which looks exactly like a factory installed resistive defroster, which will operate as effectively as and cost no more than a factory installed unit.

I have found that these aims can be obtained in accordance with this invention by the use of a pattern of heating conductors secured to the inside surface of a rear window which comprises a predetermined number of elongated parallel and equidistant heating conductors extending in a first direction and two widely spaced apart connecting conductors extending generally transversely of the first direction and being disposed over the end portions of the heating conductors, wherein each heating conductor and each connecting conductor consists of a thin pre-glued strip of solid copper or copper alloy of uniform cross-section whose width greatly exceeds its thickness. The strip of heating conductor has a layer of suitable thermo-setting adhesive over one of its wide surfaces for contacting the inside surface of the rear window. Each crossing point of heating conductors and connecting conductors is electrically connected by soldering. There should be between six and 24 heating conductors preferably between 8 and 18, providing a pattern whose resistance is of the order of between one half and one ohm.

The connecting conductors may be continuous but in most applications they will be interrupted; interruptions being provided in order to permit the arrangement of heating conductors to define a series-parallel circuit consisting of a number of serially connected sub-circuits each having two or three heating conductors connected together in parallel.

The strip of copper or copper alloy is preferably of rectangular cross-section measuring between 30 and 100 thousandths of an inch in width and by 1 and 10 thousandths of an inch thick, and in one particular embodiment the electrical circuit incorporates a two level of intensity control with means for automatically switching from the high level to the low intensity level after a predetermined period of time from initiation of the defrosting operation.

The invention further provides a method for the installation of a resistive defroster on the inside surface of the rear window in a motor vehicle which comprises the steps of cleaning the inside surface, applying a predetermined number of elongated parallel and equidistant heating conductors extending in a first direction, applying two connecting conductors generally transversely of the first direction and extending over the end portions of the heating conductors. The heating conductors and the connecting conductors consist of a thin pre-glued strip of solid copper or copper alloy of uniform cross-section whose width greatly exceeds its thickness and having a layer of suitable thermosetting adhesive over one of its wide surfaces for contacting the inside surface. The method further comprises the steps of applying heat and pressure to the heating conductors and to the connecting conductors in order to soften said adhesive and make a good bond between said conductors and said inside surface. Soldering is then effected over every crossing point of the heating conductors and connecting conductors thereby to define a pattern of resistive lines of a predetermined resistance.

The method may comprise the step of applying solder cream to every conductor crossing point and folding the free ends of every heating conductor over the adjacent connecting conductor immediately before said soldering step and the soldering step is accomplished by application of heat to every crossing point for melting the solder cream.

Alternatively certain portions of the connecting conductors may be removed between successive heating conductors thereby to define a series-parallel circuit of heating lines.

The method defined above may also comprise the additional step, immediately after cleaning of the inside surface, of securing a guide member in the vicinity of and parallel to one long edge of the inside surface and the application of the heating conductors over lines which are strictly parallel to the straight edge defined by the guide member.

Preferably the method will involve the application to the inside surface of the rear window of the various heating conductors by means of a carrier consisting of a head portion, a base adapted to roll along the guide member and an upright shaft extending from the base and supporting the head portion an adjustable distance from the base. The head portion comprises a locking device for locking the head to the upright shaft.

The invention also provides an apparatus for applying pre-glued strips of solid copper or copper alloy to the inside surface of the rear window installed in a motor vehicle which comprises a guide member presenting a straight edge and adapted to be temporarily mounted to the inside surface of the rear window with its straight edge horizontal and located toward the lower region of the rear window, a carrier comprising a head, a base and an upright shaft extending upwardly from the base. The base comprises a cross-bar and two spaced apart wheels adapted to roll along the straight edge and the shaft is straight, of constant cross-section and has a plurality of equally spaced apart index marks along its length. The head is supported to the shaft and it comprises locking means for releasably securing the head to the shaft at predetermined positions therealong corresponding to the index marks. The head comprises a coupling through which the shaft projects, and a window engaging member pivotally supported to the coupling around a first axis which is essentially perpendicular to the axis of the shaft. The window engaging member comprises a relatively wide pressure surface for pressing the strip against the inside surface of the rear window, said window engaging member also comprising a groove for receiving said strip for guiding same toward the inside surface of the rear window. Preferably the guide member comprises an elongated central section, two opposite wing sections slidably mounted to the opposite ends of the central section, means for securing each wing section to the central section with the wing sections in alignment with the central section to present a continuous straight edge defined by one edge of the central section extended by the corresponding edges of the wing sections. The guide member may comprise ruler means adjustably secured to each opposite end of the central section and extending transversely thereof to permit positioning of the guide member a predetermined distance from the base line of the rear window but parallel thereto. The central section of the guide member may comprise a plurality of spaced apart securing pads for retaining the guide member to the inside surface of the rear window, each pad comprising a foot member retained to the opposite edge of the central section and a layer of adhesive secured to each foot member for contacting the inside surface of the rear window.

Each wing section may comprise at least one longitudinally extending pointed pin projecting outwardly from the free end of each wing section.

The head of the carrier may be pivotable around the shaft even when secured thereto at one of its predetermined positions by the locking means. The pressure surface may comprise two slightly spaced apart contact areas, and in one particular embodiment these contact areas will be defined by two spaced apart rollers freely rotatably mounted to parallel axis, and in one particular embodiment a retractable fork member having two spaced apart window contacting legs is provided for aligning the head relative to the plane of the rear window.

The groove for receiving the strip may be relatively deep and may comprise a transverse pin over which the strip passes and at least covering members disposed over the groove on either sides of the pin and under which the strip passes. Means may be provided for removably retaining the covering members into the groove.

The invention also provides a method of repairing a resistive rear window defroster for motor vehicles which comprises a pattern of parallel spaced apart resistive conductors applied to the inside surface of the rear window, one or more of which being electrically interrupted and consequently inoperative. In this method the area of the rear window in the vicinity of each interrupted portion is cleaned and then a sufficient length of pre-glued solid copper or copper alloy in strip form is applied over the interrupted portion of the heating conductor so that the length of replacement conductor extends beyond the associated interrupted portion by about one half inch. The replacement conductor consists of a strip of solid copper or copper alloy of constant cross-section having on one of its wide surfaces a layer of suitable thermo-setting adhesive, and the method comprises the additional steps of removing the glue on each overlapping end portion of the replacement conductor, and securing the ends of each length of replacement conductor to the associated resistive conductor by gluing or soldering. In another method of repairing a resistive rear window defroster in accordance with this invention the factory installed pattern of parallel spaced apart resistive conductors secured to the inside surface of the rear window is removed as much as possible by scraping, the connecting conductors are electrically separated from the heating lines and a completely new pattern of heating conductors is installed which conductors consist of pre-glued strips of solid copper or copper alloy installed in the manner set forth above as if no resistive defroster had existed before except that each heating conductor will be applied directly over the location of the previous heating lines.

An examplary embodiment of this invention will now be described with particular reference to the attached drawings wherein.

Figure 1:
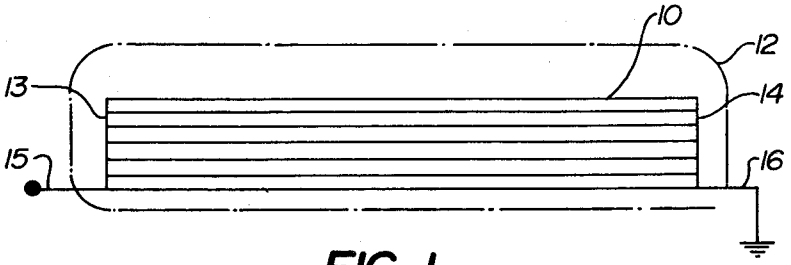
FIG. 1 shows a pattern of heating conductors with transversely extending connecting conductors disposed over the middle region of a rear window.

With particular reference to FIG. 1 a pattern of conductor lines 10 is secured to the inside surface of a rear window shown by phantom line 12, and the pattern consists of seven parallel spaced apart heating lines 10 interconnected by means of connecting conductors 13 and 14 from which leads 15 and 16 extend which are used to connect the pattern or resistive conductors across the motor vehicles' power supply. The heating conductors 10 and the connecting conductors 13 and 14 consist of a strip of pre-glued solid copper or copper alloy of uniform cross-section whose width greatly exceeds its thickness and having over one of its wide surfaces a layer of suitable thermo-setting adhesive for contacting the inside surface of the rear window 12. Each conductor is secured to the rear window by application of heat and pressure which softens the adhesive and ensures a permanent bond with the inside surface of the rear window. The strips of copper or copper alloy will be from 30 to 100 thousandths of an inch wide and their thickness may vary from between 1 to 10 thousandths of an inch. However the strip used for making the connecting conductors 13 and 14 may be wider and stronger. Practical considerations will determine the dimensions of the strip to be used in any particular situation; in particular the availability of a suitable pre-glued solid copper in strip form, the resistance of the overall pattern, the ease with which the strips can be manipulated during installation, and the strength of the strips once installed. One particularly advantageous pre-glued copper conductor is sold by Circuit-Stick Corporation under the expression "pressure sensitive copper tape" and it measures 60 thousandths of an inch by 1.4 thousandths of an inch with a layer of adhesive measuring about 2 thousandths of an inch thick extending the full width of the tape and covered by a protective film which must be peeled off before application. This particular product is identified under No. SPN 1053 and is used primarily in the construction of prototype circuit boards in the electronic field.

An adhesive of the type used in the above described product has been found to be quite satisfactory. It is stable to a temperature of about 400° F. which is important because of the soldering operation that must be carried out at very crossing point of a heating conductor and the connecting conductors and it should maintain its adhesive properties down to about minus 40° F. The force of retention should be sufficiently high when the adhesive is applied to a glass panel to ensure that the strips of conductors will be permanently secured. It is particularly advantageous to use a glue which will soften upon application of heat to a temperature of about 300° F. and which will then regain its full adhesive qualities at room temperature or colder down to about minus 40° F. Such a glue will hereinafter be called a thermo-setting glue or adhesive and is the preferred type as it permits application of heat and pressure over the conductors for permanently bonding the conductors to the inside surface of the rear window.

It must be borne in mind that the methods for the installation of resistive defrosters to be described and defined hereinafter are adapted to be carried out without having to remove the rear window from the assembled motor vehicle. Therefore in FIGS. 1, 4 and 5 where a rear window is shown, it should be understood that the rear window is installed inside a motor vehicle.

Thus, as shown in FIG. 1, a plurality of equally spaced apart heating conductors are installed against the inside surface of a rear window 12 and leads 15 and 16 and interconnecting conductors 13 and 14 permit the application of a direct current voltage across the pattern of heating conductors 10 which in accordance with this invention are made of solid copper or copper alloy secured to the inside surface of the rear window 12. When the circuit is closed a current passes through the heating conductors 10 and the heat generated will be sufficient to dissipate fogging or frost that would otherwise accumulate against the inside surface of rear window 12. The power consumed by the rear window defroster must be of an extent which is compatible with the motor vehicle's electrical supply and usually the consumed power must be limited to about 200 watts. In the case of a more powerful electrical supply using a so called heavy duty alternator the power of the rear window defroster can be increased to about 400 watts. Alternatively a two intensity level control unit may be used in order to permit two levels of power to be used namely a high intensity level for the first few minutes of operation which will accelerate the defrosting or defogging process followed by continuous operation at a low intensity level which will be less demanding on the motor vehicle's electrical circuit. The amount of power consumed by the resistive defroster is of course related to the resistance of the network of heating conductors. In a typical example where the available power is 200 watts in a nominal 12 volt d.c. system providing a voltage of 14 volts the resistance of the network will be of the order of 1 ohm. For a more powerfull defroster using for example 400 watts in the same 12 volt system, the resistance of the resistive network will be of the order of one half ohm.

Figure 2:
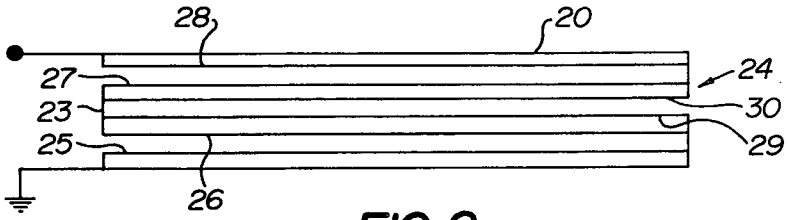
FIG. 2 is a different pattern of heating conductors wherein the connecting conductors have been interrupted in order to obtain a series-parallel circuit comprising four serially connected sub-circuits each of which having two parallel conductors.
Figure 3:
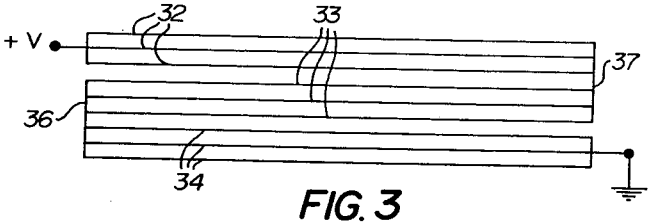
FIG. 3 shows an alternative series-parallel pattern of conductor lines consisting of three serially connected subcircuits each having three parallel heating conductors.

When using a strip of solid copper of a predetermined linear resistivity to install a resistive defroster in a rear window of a particular dimension, the operator must determine the resistance of the overall network and then the area of the rear window to be covered by the pattern. Depending on the dimensions of the area to be defrosted he will have to select the number of parallel heating conductors 10 to be installed and tables or charts may be made available for this purpose. The distance between successive heating conductors 10 is relatively fixed. In practice it will be about 1 and ⅛ of an inch plus or minus ⅛ of an inch. Otherwise loss of energy or improper defrosting may result. Consequently for the parallel circuit shown in FIG. 1 the operator will have to determine the number of heating conductors 10 and this will give him the length of these conductors, and of course with fewer heating conductors each will be longer. However for different sizes of rear windows or if a copper strip of a different linear resistivity is available he may decide to adopt a series-parallel circuit arrangement as illustrated in FIGS. 2 and 3. In FIG. 2, eight parallel heating conductors 20 are shown but the connecting conductors 23 and 24 are interrupted so as to provide an arrangement of four parallel sub-circuits each consisting of two parallel consecutive heating lines. This is achieved by providing two interruptions in connecting conductor 23: the first interruption appearing between heating conductors 25 and 26, the second interruption appearing between conductors 27 and 28. There is one interruption in connecting conductor 24 between heating conductors 29 and 30, in FIG. 3 there are three serially connected sub-circuits each consisting of three consecutive heating conductors connected in parallel, namely the first, second and third conductors identified by reference numeral 32 are connected together in parallel, the three intermediate heating conductors 33 are connected together and finally the last three heating conductors 33 are connected together by means of the interrupted connecting conductors 36 and 37. The connecting conductor 36 is interrupted at the space between the sub-circuits 32 and 33 whereas the connecting conductor 37 is interrupted between the sub-circuits 33 and 34.

Figure 5:
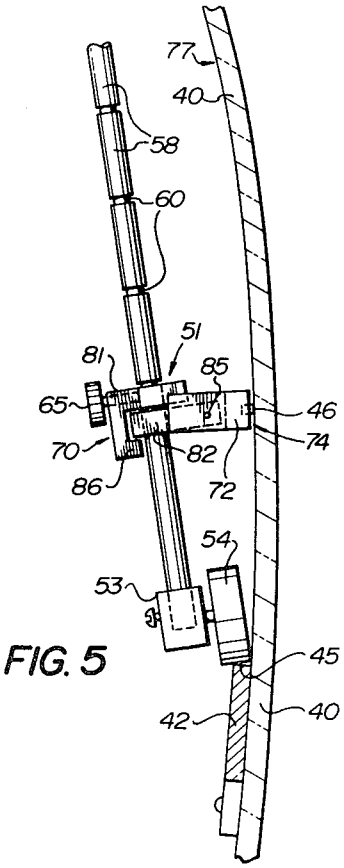
FIG. 5 is an enlarged side elevation view of a carrier whose base is in contact with the guide member temporarily secured to the rear window which is seen in cross-section.
Figure 4:
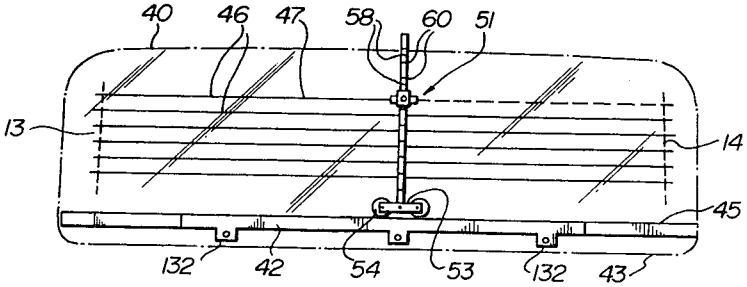
FIG. 4 illustrates the method of applying the sixth conductor line over a rear window using a guide member and a carrier in accordance with this invention.

FIG. 4 illustrates in phantom line a rear window 40 to which a guide member 42 has been temporarily secured towards the lower edge 43 of window 40 and guide member 42 presents an upper straight edge 45 which is parallel to the lowest edge 43 of window 40. A carrier is used for applying the successive heating conductors 46 in a pattern which comprises six heating conductors. In FIG. 4, the upper conductor 47 is shown as being only partially installed. Its preliminary installation will be completed by running the carrier or applicator to the right-hand edge of window 40. The carrier comprises a head 51, a base 53 that includes a cross-bar and two spaced apart wheels 54 which are adapted to roll along the striaght edge 45 of guide member 42. An upright shaft 58 which is best shown in FIG. 5 extends upwardly from base 53. Shaft 58 is essentially straight, of constant cross-section and has a plurality of equally spaced apart index marks 60 along its length. In practice shaft 58 could be slightly curved if it is long enough in order to better conform to the shape of certain rear windows and not interfere with the upper moulding of the window. Shaft 58 supports the head portion 51 which comprises a locking means 65 for releasebly securing the head to the shaft at predetermined positions along shaft 58 corresponding to index marks 60.

Preferably shaft 58 will be of circular cross-section and each index mark 60 will be defined by a groove of uniform depths so that the head 51 will remain rotatable about shaft 58 even when secured thereto by locking means 65.

Figure 6:
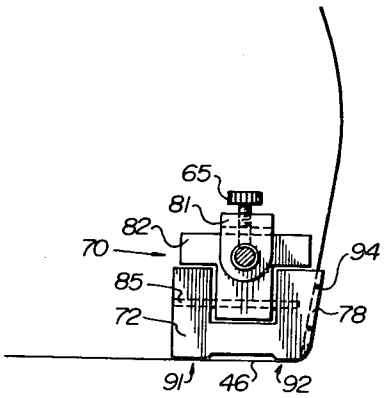
FIG. 6 is a plan view of one embodiment of the head of a carrier wherein the locking means is in the form of a set screw.
Figure 7:
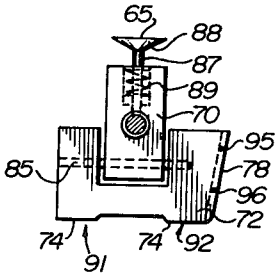
FIG. 7 shows a slightly modified embodiment of a carrier head wherein the locking means is a spring loaded retractable pin.

Head 51 comprises a coupling 70 as shown in FIGS. 5, 6 and 7, through which shaft 58 projects. Head 51 also comprises a window engaging member 72 also seen in FIGS. 5, 6 and 7 which has a relatively wide pressure surface 74 for pressing the pre-glued strip of copper 46 against the inside surface 77 of rear window 40 as best illustrated in FIG. 5. The window engaging member 72 comprises a groove 78 which can only be seen in FIGS. 6 and 7 and the purpose of the groove is to receive the strip of pre-glued copper 46 for guiding same towards the inside surface 77 of the rear window 40.

As shown in FIGS. 5 and 6 coupling 70 can be made of two parts where the locking member 65 is in the shape of a set screw as in FIGS. 5 and 6. In this arrangement the coupling comprises a first component 81 which carries the set screw 65 and which has an aperture for receiving shaft 58. Coupling 70 comprises a second component 82 which projects from the first component 81 to the window contacting element 72 and which serves to pivotally connect the window contacting element 72 about axis 85 which is essentially parallel to guide member 42 and to the rear window 40. The first component 81 is fixedly secured to shaft 58 by means of set screw 65 but the second component 82 is free to rotate slightly about shaft 58 and is retained at a given position therealong by means of a projection 86 located on the lower portion of first member 81 as best seen in FIG. 5. The combination of a two element coupling 70 with the pivotal connection 85 results in a universal pivotal connection of the window engaging element 72 relative to shaft 58 and this is important in order to ensure that the window engaging surface 74 will remain flat against the inside surface 77 of window 40 throughout each application of heating conductor 46.

In FIG. 7 the coupling 70 is made of only one component pivotally connected to the window engaging member 72 by means of axis 85. In this arrangement locking member 65 consists of a slidable pin 87 having a head portion 88 extending outside of coupling 70 and having a cylindrical projection which is adapted to fit into a groove 60 along shaft 58. A coil spring 89 biases locking means 65 inwardly so as to maintain the inner projection of the slidable pin 87 into one of grooves 60 along shaft 58. Coupling 70 is therefore freely pivotable about shaft 58 and its position therealong can be changed by withdrawing pin 87 by means of its head portion 88 and then sliding coupling 70 to the desired index mark or groove 60 along shaft 58.

Freely pivotable connection of carrier 51 to shaft 58 is important when the pressure surface 74 is relatively long as shown in FIGS. 6 and 7 where said surface actually consists of two spaced apart contact areas 91 and 92.

As noted above, the pre-glued strip of copper is received inside groove 78 and then is extended over the length of the pressure surface 74. With reference to FIG. 4, the application of each heating conductor 46 would begin from the left-hand side region of the rear window 40 and then the carrier will be slowly moved to the right with some pressure being applied to the head portion 51 so as to cause initial adhesion of the strip to the inside surface 77 of window 40. Pre-glued strip 46 has a protective film 94 over its layer of adhesive and this protective film 94 which is shown in FIG. 6 must be removed immediately prior to application. To this effect a first guide pin 95 is provided across groove 78 a slight distance from the bottom of groove 78. The function of this pin is to retain the copper strip 46 inside the groove but it also acts to separate the protective film 94 from the layer of adhesive. A second pin 96 is provided across 78 a short distance away from the first pin 95 towards the pressure surface 74 and its function is merely to ensure that the strip 46 will remain inside the groove which will then guide the strip to the immediately adjacent region on inside surface 77 of window 40.

In operation when it is desired to install a pre-selected number of heating conductors to the inside surface 77 of a rear window such as at 40 in FIG. 4, the operator installs a guide member 42 as close as possible to the lowest edge of window 40 after having thoroughly cleaned the inside surface 77. In certain motor vehicles it is not essential to use a guide member 42 because the pre-existing moulding (not shown) is sufficiently straight and presents a satisfactory straight edge for guiding the carrier. Then the operator locks head 51 to the proper one of index marks 60 along shaft 58 and then starting from one end of the rear window he applies a first heating conductor. The installation of each heating conductor comprises the steps of threading a strip of pre-glued copper 46 through groove 78 in the head of the carrier and extending the projected end of the strip 46 across the full length of the pressure surface 74 of head 51 and then making initial contact of strip 46 with the inside surface 77 of window 40 starting at one extremity of the window, for example as far left as possible. Then with a gradual motion the operator will move the carrier along the straight edge 45 all the way across the inside surface 77 to the righthand side edge of window 40 maintaining an even pressure over head 51 and permitting strip 46 to pass through groove 78 and remain secured to surface 77. For each successive heating conductor 46 the operation involves resetting of head 51 to the next following index mark 60 and threading the leading end of a further length of the pre-glued strip of conductor 46 through groove 78 and then making initial application starting from the left-hand side of window 40 and then moving the applicator or carrier along the surface maintaining an even pressure over head 51 and keeping wheels 54 of base 53 on constant contact with straight edge 45.

Having applied the required number of heating conductors 46 the operator will then apply two connecting conductors which will overlie the extreme portions of the heating conductors 46. Connecting conductors 13 and 14 which may be considerably wider than the heating conductors will be located as close as possible to the opposite edges of window 40 and in fact where it is practical to do so the inside moulding "not shown" of window 40 will have been removed prior to the installation of the conductors so that the connecting conductors 13 and 14 will be located inside the moulding and will be totally invisible after completion of the installation and mounting of the moulding back into place.

Where it is desired to make a series-parallel circuit, sections of the connecting conductors 13 and 14 will be removed by using a sharp blade for cutting completely through strips 13 or 14.

The next operation involves heating of each conductor 46, 13 and 14 by using a heating device. A particularly suitable heating device is a soldering gun having a relatively long heating bar (not shown) pivotally mounted at its central region to the tip of the gun. The length of the heating bar should be sufficient to contact two successive heating conductors 10, 20 or 46. The bar should be made of copper or aluminum for conducting heat from the tip to conductors 10, 20 or 46. A heating gun of the 35 to 50 watt pencil type has been found adequate. This operation softens the adhesive and with a slight uniform pressure a permanent intimate bonding is obtained.

Figure 13:
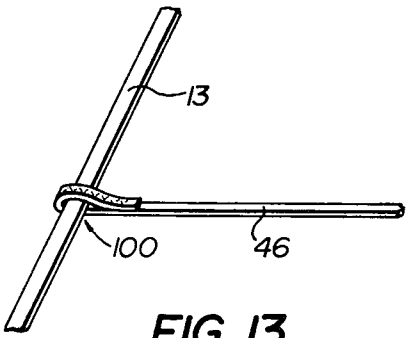
FIG. 13 shows how the heating conductors are folded over the connecting conductors for forming crossing points which will be soldered in order to obtain a good electrical connection.

Soldering is effected by applying solder in cream form over each conductor cross point 100 and then folding the free end of each heating conductor 46 over the associated connecting conductor 13 or 14 as best shown in FIG. 13. A heating conductor overlap of about $\frac{3}{4}$ of an inch should be sufficient. Thus the excess length of heating conductors 46 should be cut with sharp cisors or cutting pliers. Then heat and very slight pressure is applied over each cross point 100 sufficiently to completely melt the soldering cream and ensure a good electrical connection. Soldering cream has been found satisfactory in making good electrical connections but care must be taken to ensure that enough soldering material will remain between the mating surfaces during heating. Obviously, solder in solid form could be used as a substitute for soldering cream especially where a less resistive connection is required. The quality of the connections at cross points 100 should be verified by measuring the resistance of the pattern or of each sub-circuit with a simple ohmmeter and all defective connectons should be reheated. The connecting conductor 13 shown in FIG. 13 is of the same thickness but is twice as wide as heating conductor 46 ensuring more strength and current carrying capacity.

In practice a rear view resistive defroster in accordance with this invention has between 6 and 24 heating conductors 10, 20 or 46. In most applications the number of heating conductors will vary between 8 and 18 so as to produce a rectangular or trapezoidal heating pattern of sufficient height. In the case of a series-parallel circuit wherein each sub-circuit consists of two heating conductors connected in parallel there will be between 4 and 9 sub-circuits. Where each sub-circuit comprises 3 adjacent heating conductors connected together in parallel there should be between 9 and 18 heating conductors and therefore between 3 and 6 sub-circuits.

Figure 8:
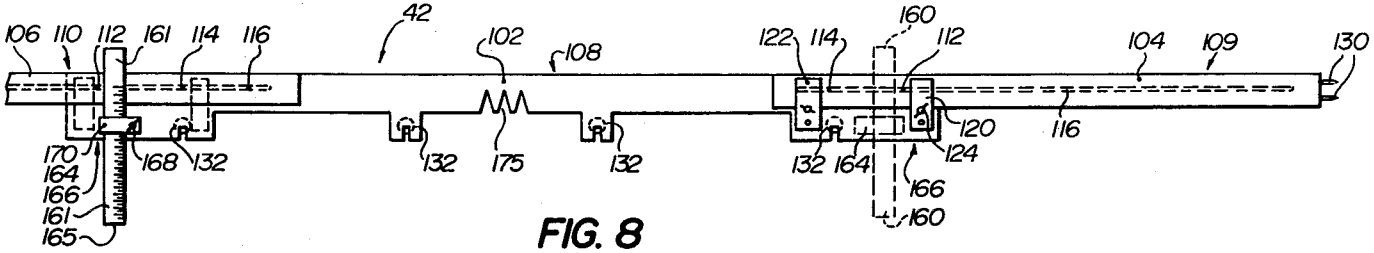
FIG. 8 is a plan view of a guide member.
Figure 9:
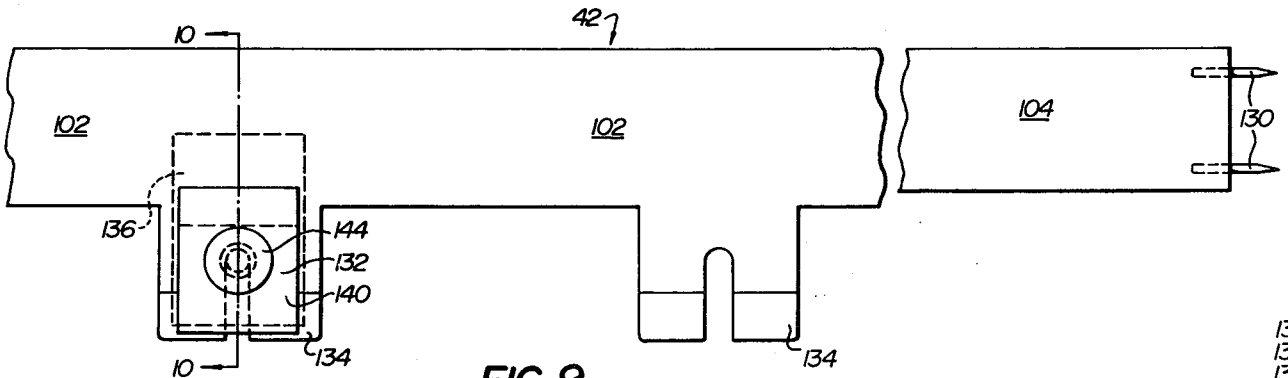
FIG. 9 is a plan view of a portion of a guide member but in an enlarged scale when compared to FIG. 8.
Figure 10:
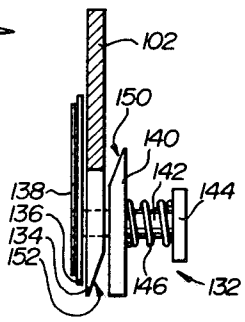
FIG. 10 is a cross-sectional view taken along line 10—10 of FIG. 9.

FIGS. 8, 9 and 10 illustrate a guide member 42 which comprises an elongated central section 102, two opposite wing sections 104 and 106 slidably mounted to the opposite ends of the central section 102, and means for securing each wing section 104, 106 to the central section 102. One edge 108 of the central section defines a straight edge which is extended by the corresponding edges 109 and 110 of the respective wing sections 104, 106 and therefore the securing means must maintain the wing sections 104 and 106 in good alignment with the central section 102. To this effect the central section 102 carries two spaced apart pins 112 and 114 which project a short distance beyond one surface of central section 102 to ride into a groove 116 in the corresponding wing section 104 or 106. The securing means also comprises for each wing section 104, 106 a pair of spaced apart clamping members 120 and 122 with tightening means 124 comprising a wing nut 121 on a small screw for manually urging the clamping members 120 or 122 towards the underlying portion of the central section 102. Thus when the wing nuts 121 are tightened sufficiently the associated wing section 104 or 106 is sufficiently securely retained in alignment with the central section 102. As best illustrated in FIG. 8 the central section 102 comprises two securing means for the wing sections 104 and 106, one at each end of the central section 102 but in FIG. 8 only one securing means is shown in details.

As shown in FIGS. 8 and 9 the free end of each wing section 104, 106 comprises at least one pointed pin 130 and preferably two such pins 130 will be used as shown in FIGS. 8 and 9. The purpose of pin 130 is to project into and consequently engage with the resilient or soft material which is usually found bordering the side edges of the inside surface of a motor vehicle's rear window. The central section 102 also requires retaining means for temporarily holding central section 102 to the inside surface of the rear window during installation of a defroster. To this effect two or more spaced apart securing pads 132 are mounted to slotted extensions 134 of the central section 102, each pad comprising a foot member 136 and a layer of adhesive 138 under foot member 136. As best seen in FIGS. 9 and 10 each securing pad 132 also comprises an upper clamping member 140 through which projects shaft 142 secured to foot member 136 and having an enlarged head 144 whose purpose is to retain a coil spring 146 in compression for urging clamping member 140 towards foot member 146. Thus each covering pad 132 is frictionally retained to the edge of central section 102 which is opposite to the straight edge 108 thereof. Engagement of the securing pads 132 with the extensions 134 of central section 102 will be facilitated by undercutting at an angle the leading edge of clamping member 140 as at 150 in FIG. 10 and by also grinding the leading edge of each projection 134 in a slope or ramp as at 152.

With reference to FIG. 8, parallel positioning of the central section 102 to the base of the window may be facilitated by the use of two spaced apart ruler means 160 and 161 which are adjustably secured to each opposite end of the central section 102 and which extend transversely thereof. A clamping member 164 may be used for retaining each ruler means 160, 161 with their respective lower end 165 a given distance below the lowest edge 166 of the adjacent widened portion of central section 102. To this effect clamping member 164 may be tightened by means of a screw and wing-nut arrangement 168 at one end with a suitable fastener such as a rivet or bolt retaining the opposite end as at 170.

In certain applications it may be necessary to bend straight edge 108 at its middle point to accomodate for certain rear windows which are made of two glass panes glued together along their mating edge which is located in a longitudinal plane in the middle of the rear window. In order to permit bending of the guide member, the middle region of the central section 102 may comprise one or more V-shaped slots 175 opening on the edge opposite straight edge 108 and extending about half way into central section 102.

In practice we have found that the guide member 42 can be made of fairly rigid plastic material such as polyethylene and the width of the central section 102 and of wing sections 104 and 106 may be of the order of one inch while their thickness may be about ⅛ of an inch. In order to keep sufficient rigidity in the wing sections 104, 106 the depth of groove 116 should be less than the thickness of the wing sections.

Figure 12:
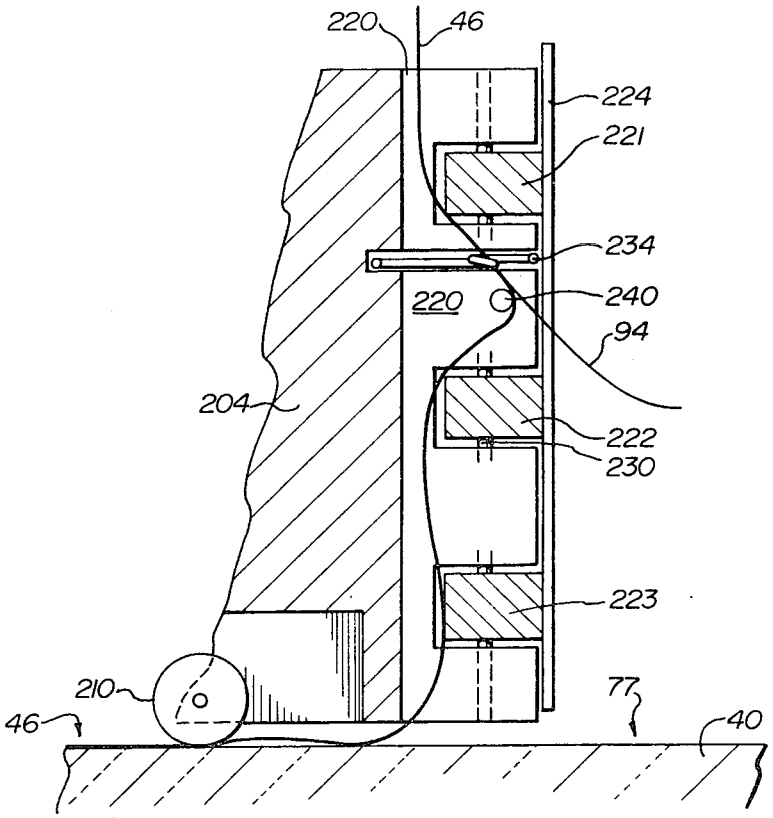
FIG. 12 is a partial cross-sectional view in enlarged scale of the embodiment shown in FIG. 11 and taken in the median plane of the head of FIG. 11 but which shows the covering members in place over the groove.
Figure 11:
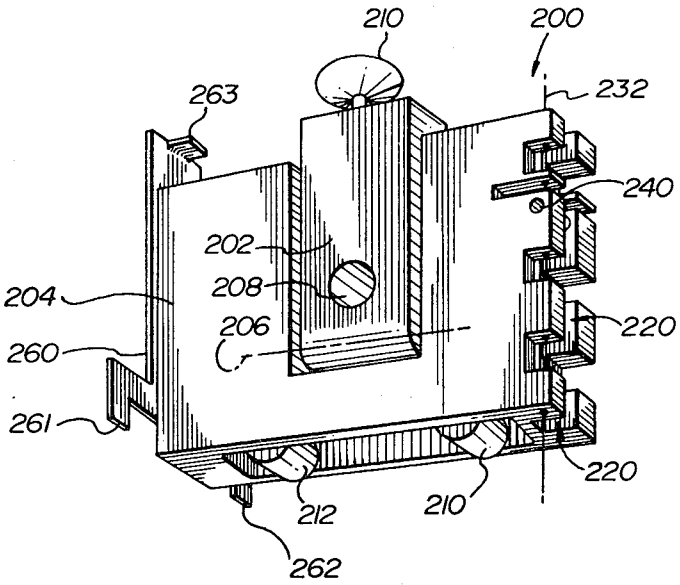
FIG. 11 is a perspective view of a third embodiment of the head portion of a carrier in accordance with this invention but wherein the covering members for the groove have been removed in order to simplify the illustration.

In FIGS. 11 and 12 a different embodiment of the head portion 200 of an applicator or carrier is shown which is designed to be used in conjunction with the base 53 and the upright shaft 58 shown in FIGS. 4 and 5. Carrier 200 comprises a coupling 202 to which window engaging member 204 is pivotally connected along axis 206. Cylindrical bore 208 is adapted to receive upright shaft 58 and it comprises a spring biased locking means 210 which is essentially similar to locking means 65 illustrated in FIG. 7.

The pressure surface of window engaging member 204 is defined by two spaced apart rollers 210 and 212 which are adapted to roll over the pre-glued strip of copper 46 and press same against the inside surface 77 of window 40. Rollers 210 and 212 are freely rotatable around respective axes which are parallel and spaced apart.

A groove 220 is provided along one edge of carrier 200 for receiving and guiding strip 46 in a manner similar to groove 78 shown in FIGS. 6 and 7.

However instead of pins 95 and 96 as shown in FIGS. 6 and 7 at least two spaced apart covering members 221, 222 and 223 are provided which, as shown in FIG. 12, are interconnected together by a bar 224 and the assembly is pivotally connected to the adjacent portions of window engaging member 204 by a longitudinal pin 230 which extends along axis 232. A small coil spring 234 having its single coil around pin 230 urges bar 224 outwardly so as to move the covering members 221, 222 and 223 out of groove 220 permitting insertion of strip 46 into groove 220 at the beginning of each heating conductor application. A simple locking device or latch (not shown) is used to counteract the action of coil spring 234 and keep covering members 221, 222 and 223 inside groove 220 during application of strip 46. In order to simplify the illustration of this embodiment, covering members 221, 222, 223 and bar 224 are shown only in FIG. 12.

Transversely extending pin 240 forces strip 46 to pass away from the bottom of groove 220 and to follow a curved path over pin 240 and this causes separation of protective film 94 from the layer of adhesive on strip 46. If there is too much friction between covering member 222 and the pre-glued surface of strip 46, a small roller (not shown) should be installed at the interfering corner of covering member 222. This roller would be freely rotatable around an axis parallel to pin 240.

Initial positioning of the window engaging member 204 at the starting point of each heating conductor substantially perpendicularly to the inside surface 77 of window 40 is greatly facilitated by use of a retractable fork member 260 having two spaced apart legs 261 and 262 whose extremities are always parallel to the parallel spaced apart axes of rollers 210 and 212. For making initial contact of strip 46 with the inside surface 77 of window 40, the operator pushes the upper tab 263 of fork member 260 downwardly thereby extending legs 261 and 262 beyond the plane that contains the contact areas defined by rollers 210 and 212. Once legs 261 and 262 are in contact with the glass surface 77 at the proper level thereon, the operator further presses the window engaging member 204 against the glass surface 77 which causes the starting portion of strip 46 to come in contact with glass surface 77 at the proper position. At that point fork member 260 can be retracted and the operator can move carrier 200 transversely of the rear window 40 and thus apply the corresponding heating conductor. Retraction of fork member 260 may be facilitated by using a return spring (not shown) urging fork member 260 to the retracted position and counteracted by means of a detent or latch (not shown) which the operator could actuate once legs 261 and 262 have come into contact with glass surface 77.

As noted above a high power resistive defroster in accordance with the invention may be used in conjunction with an electrical control circuit providing two levels of intensity, comprising a low level which requires a limited amount of power, and a high level which could temporarily reach or even exceed the maximum output of the vehicle's electrical supply generator or alternator but which would be in use only for a limited period of time. A simple timing device such as a clock would be appropriate for determining the maximum period of operation at the high intensity level after which an alarm signal would be sounded or a warning light or flasher would turn on to indicate to the driver of the vehicle that the defroster system should be switched to the low intensity level for continuous operation.

I have found that my method for installation of a resistive defroster as described above can also be used to repair interrupted lines in factory installed resistive rear window defrosters. Whereas very minor damages can sometimes be repaired by means of conductive glue bridging the interruption, this technique fails in the case of more important damages. In such cases, and in accordance with this invention, the method of repairing comprises the steps of cleaning the surrounding area of the rear window and once the exact location of the interruption has been identified a sufficient length of pre-glued copper or copper alloy replacement conductor is disposed over the interrupted portion of the pre-existing heating conductor with the ends of the replacement conductor extending beyond the interruption by about ½ of an inch. The layer of glue should be removed from the overlapping portions of the replacement strip. I then apply heat over the replacement conductor to permanently secure it in place. The end portions of the replacement strip are then soldered to the underlying heating line or conductor using a small amount of solder cream which is melted in place with an ordinary soldering gun or pencil. Care must be taken to ensure that the heat will not dissolve the substance of the pre-existing conductor line. In many cases the interruption was caused by the fact that the heating line was too thin in that particular region. Therefore it may be preferable to connect the replacement strip by means of conductive glue instead of soldering. The repair glue which is normally supplied by the car's manufacturer for repairing very minor defects or damages to the resistive defroster, as noted above, should be the most suitable conductive glue.

Where the pre-existing resistive defroster is too badly damaged there being major interruptions in pre-existing heating lines or conductors, the repair of the factory installed network may become too expensive or even impossible. In accordance with this invention a method is provided for replacing factory installed pattern by a completely new set of heating conductors which comprises the steps of removing as much as possible of the remaining heating lines such as by scraping taking care not to scratch or mar the inside surface of the rear window. The connecting lines or conductors should be completely disconnected from the heating lines. The inside surface is then properly cleaned and then a new pattern of heating conductors is installed with the method described above in connection with FIGS. 1 to 4 except that each replacement conductor is disposed directly over factory installed heating lines. The installation may have to be made by hand where the pre-existing lines are not strictly parallel to one another or where the lines are not sufficiently straight. New connecting conductors are disposed transversely of the heating conductors. The individual replacement conductors are then heated for softening the adhesive of the pre-glued strips of copper or copper alloy and then the crossing points of heating conductors and connecting conductors are soldered in the manner shown in FIG. 13. The pre-existing supply lines are then connected to the respective terminals of the new pattern and this completes the assembly. The replacement heating conductors and connecting conductors strips are the same pre-glued solid copper or copper alloy materials described above and used in the installation of a completely new defroster.

A resistive defroster made of solid copper or copper alloy strips in accordance with this invention can be easily repaired if one or more conductors happens to break. The method for repairing such defrosters involves the steps of cutting the damaged conductor with a razor blade or the like a short distance on each side of the interruption and removing the section of damaged conductor thus leaving a gap of a few inches long. The area is then cleaned and then a piece of replacement strip is prepared. The length of the new strip should exceed the length of the gap by about 1 inch. The layer of glue is removed at each end of the new strip over a distance of about one half inch so that the overlapping portions will make a good electrical connection. The protective film is then removed from the strip which is put in place with its end portions overlapping the inner ends of the damaged conductor. A small amount of soldering cream is disposed between the contacting end surfaces and heat is applied for soldering the new strip to the pre-existing conductor.

The embodiments of the invention in which an exclusive property or privilege is claimed are defined as follows:

1. A method for the installation of a resistive defroster on the inside surface of the rear window in a motor vehicle comprising the steps of cleaning said inside surface, applying a predetermined number of elongated parallel and equidistant heating conductors extending in a first direction, applying two connecting conductors generally transversely of said first direction and extending over the end portions of said heating conductors, said heating conductors and said connecting conductors consisting of a thin pre-glued strip of solid copper or copper alloy of uniform cross-section whose width greatly exceeds its thickness and having a layer of suitable thermo-setting adhesive over one of its wide surfaces for contacting said inside surface, said method comprising the additional steps of applying heat and pressure to said heating conductors and to said connecting conductors in order to soften said adhesive and make a good bond between said conductors and said inside surface, soldering every crossing point of said heating conductors and said connecting conductors thereby to define a pattern of resistive lines of a predetermined resistance, and connecting said pattern across a switched supply of electrical energy.

2. The method defined in claim 1 wherein said predetermined number of heating conductors is between 6 and 24, and wherein the spacing between adjacent heating conductors is about one inch.

3. The method defined in claim 2 wherein said number of heating conductors is between 8 and 18 and wherein said spacing is equal to 1 and one eighth inches.

4. The method defined in claim 2 comprising the steps of applying solder cream to every conductor crossing point and folding the free ends of every heating conductor over the adjacent connecting conductor immediately before said soldering step, and wherein said soldering step is accomplished by application of heat to every crossing point for melting said solder cream.

5. The method defined in claim 4 comprising the additional step of removing portions of said connecting conductors between successive heating conductors thereby to define a series-parallel circuit of heating lines.

6. The method defined in claim 5 wherein said series-parallel circuit comprises between 4 and 9 serially connected sub-circuits of heating conductors, each sub-circuit consisting of two adjacent heating conductors connected together in parallel.

7. The method defined in claim 5 wherein said number of heating conductors is between 9 and 18 and wherein said series-parallel circuit comprises between 3 and 6 serially connected sub-circuits of heating conductors, each sub-circuit consisting of three adjacent heating conductors connected together in parallel.

8. The method defined in claim 1 comprising the additional step, immediately after cleaning said inside surface, of securing a guide member in the vicinity of and parallel to one long edge of said inside surface, and wherein said heating conductors are applied to said inside surface in a direction parallel to said guide member.

9. The method defined in claim 8 wherein each heating conductor is applied to said inside surface by means of a carrier consisting of a head portion, a base adapted to roll along said guide member, and an upright shaft extending from said base and supporting said head portion an adjustable distance from said base, and wherein said head portion comprises a locking device for locking said head to said upright shaft.

10. A method of repairing a resistive rear window defroster for motor vehicles, which comprises a pattern of parallel spaced apart resistive conductors applied to the inside surface of said rear window, one or more of which being electrically interrupted and consequently inoperative, said method comprising the steps of cleaning the area of the rear window in the vicinity of the interrupted portion of each interrupted resistive conductor, applying a sufficient length of pre-glued solid copper or copper alloy replacement conductor over each of said interrupted portion so that the length of replacement conductor extends beyond the associated interrupted portion by about at least one half inch, removing the glue from the overlapping end portions of said replacement conductor, said replacement conductor consisting of a strip of solid metal of constant cross-section measuring between 30 and 100 thousandths of an inch wide by between 1 to 10 thousandths of an inch thick and having on one of its wide surfaces a layer of suitable thermo-setting adhesive, applying heat and slight pressure to said replacement conductor for softening said adhesive and connecting the ends of each length of replacement conductor to the associated resistive conductor.

11. A method as defined in claim 10 wherein the connecting step comprises securing the overlapping ends by a conductive glue.

12. A method as defined in claim 10 wherein the connecting step comprises securing the overlapping ends by soldering.

13. A method of repairing a resistive rear window defroster for motor vehicles which comprises a factory installed pattern of parallel spaced apart resistive conductors fixed to the inside surface of said rear window, comprising the steps of removing by scraping as much of the material of said resistive conductors as possible, and then installing a new pattern of heating conductors in accordance with the method defined in claim 1 and wherein each heating conductor is disposed over the exact location of a previous resistive conductor.

* * * * *